US006847306B2

(12) United States Patent
Diba et al.

(10) Patent No.: US 6,847,306 B2
(45) Date of Patent: Jan. 25, 2005

(54) EMERGENCY TRAFFIC SIGNAL ATTACHMENT

(76) Inventors: Keyvan T. Diba, 11841 Goshen Ave., #4, Los Angeles, CA (US) 90049; Payam Manavi, 4069 Caminito Suero, San Diego, CA (US) 92122

( * ) Notice: Subject to any disclaimer, the term of this patent is extended or adjusted under 35 U.S.C. 154(b) by 69 days.

(21) Appl. No.: 10/439,361

(22) Filed: May 16, 2003

(65) Prior Publication Data

US 2004/0008126 A1 Jan. 15, 2004

Related U.S. Application Data

(60) Provisional application No. 60/380,941, filed on May 17, 2002, and provisional application No. 60/380,925, filed on May 17, 2002.

(51) Int. Cl.[7] ..... G08G 1/07

(52) U.S. Cl. ..... 340/906; 340/907; 340/815.75; 340/902; 362/800; 359/227

(58) Field of Search ..... 340/906, 907, 340/902, 910, 916, 924, 815.47, 815.41, 930, 931; 116/63 R; 701/116–122; 40/612; 362/800; 359/531–533, 227, 552, 547

(56) References Cited

U.S. PATENT DOCUMENTS 5,187,476 A * 2/1993 Hamer ..... 340/906
6,072,406 A * 6/2000 Leonard et al. ..... 340/902
6,232,889 B1 * 5/2001 Apitz et al. ..... 340/906
6,392,563 B1 * 5/2002 Paquette et al. ..... 340/907
6,448,904 B1 * 9/2002 Flores ..... 340/906
6,633,238 B2 * 10/2003 Lemelson et al. ..... 340/909
2003/0156044 A1 * 8/2003 Wiseman ..... 340/907

* cited by examiner

*Primary Examiner*—Jeffery Hofsass
*Assistant Examiner*—Eric Blount
(74) *Attorney, Agent, or Firm*—Birch, Stewart, Kolasch & Birch LLP; Thomas M. Small

(57) ABSTRACT

An attachment for a traffic signal having a housing for fitting over one of the normal lights, herein the green light, of the signal and overriding the normal sequence in response to preemptive emergency signals, and a electro-optically responsive data display panel on the housing to provide clear and direct instructional messages to motorists as to the appropriate actions to be taken. A first embodiment overrides the normal green light with a reflective electro-optically responsive panel overlying the normal green light to become opaque in response to the emergency signals, with a red light source outside the panel that is activated to produce red reflected light. A second embodiment replaces the normal green (or alternatively yellow or red) signal with a panel of light-emitting elements (LEDs) that have one group capable of providing the normal green signals and a second group that are capable of providing graphic instructions in response to emergency signals. In both embodiments, the display panels provide alternate selections such as "STOP" or a halt symbol as one selection and an arrow or chevron pattern, with "RIGHT" or an abbreviation as a second selection.

34 Claims, 2 Drawing Sheets

FIG. 4
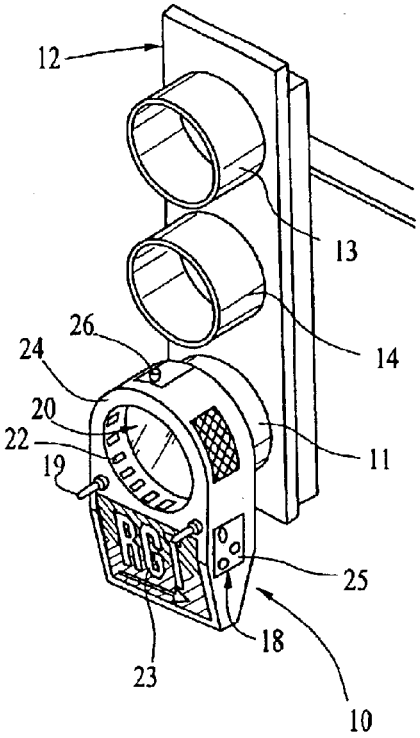
FIG. 5
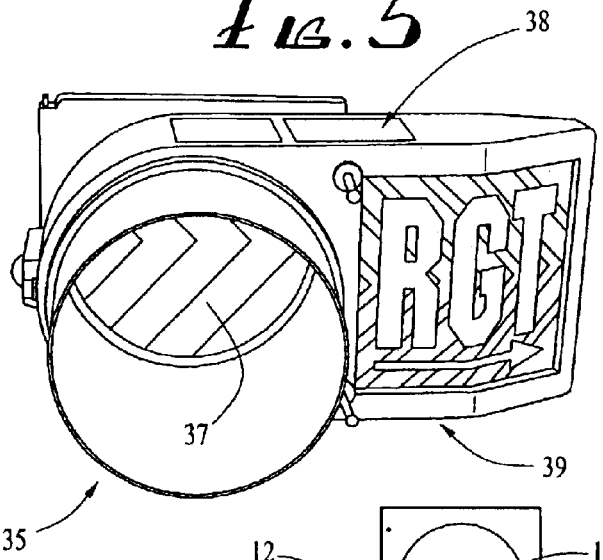
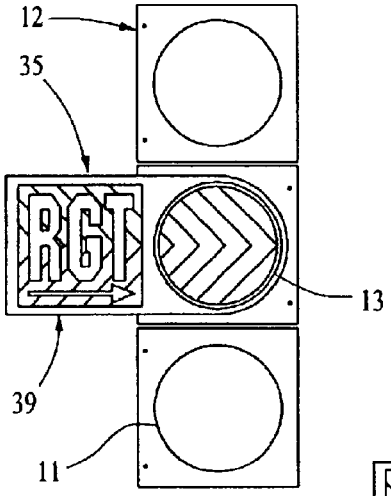
FIG. 7
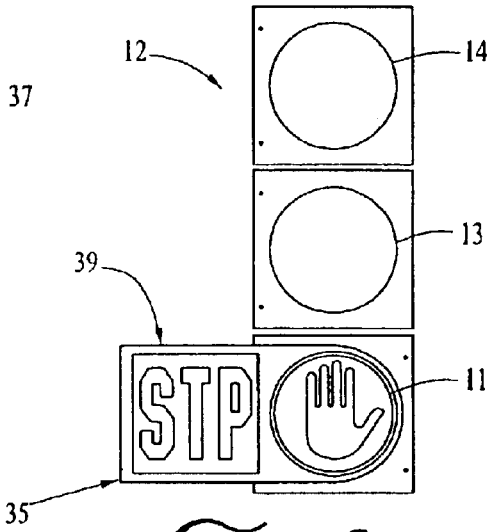
FIG. 6
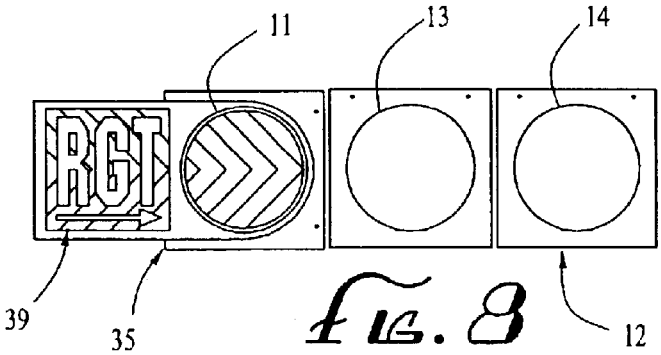
FIG. 8

EMERGENCY TRAFFIC SIGNAL ATTACHMENT

REFERENCE TO PRIOR PROVISIONAL APPLICATIONS

This application claims the benefit of prior copending provisional applications Ser. No. 60/380,941, and 60/380,925, both filed May 17, 2002.

BACKGROUND OF THE INVENTION

This invention relates to traffic signals for controlling traffic flow at intersections of roadways, and relates more particularly to systems that modify traffic signal operation in response to emergency vehicle signals to permit the emergency vehicle to pass quickly and safely through the intersection, and to methods of controlling such signals.

Traffic signals have been used for many years to regulate traffic flow at intersections, typically providing a green or "go" light for traffic on one street at preselected intervals while providing traffic on the intersecting street with a red or "stop" light. During the transition from "go" to "stop", it is customary to provide a yellow or "caution" light for a short interval, warning oncoming motorists to prepare to stop when the red light appears. All three lights often are mounted in a common housing or frame, usually in a vertical row but sometimes horizontally aligned.

When an emergency vehicle such as a police car, fire truck or ambulance must pass rapidly through an intersection, the oncoming emergency vehicle typically sounds an audible warning such as a siren and a visual warning such as a flashing light, and then proceeds through the intersection without regard to the existing condition of the traffic signal. For various reasons, these signals are not always sufficient to avoid collisions. Loud noises, closed vehicles with radios or other audio devices playing, and inattentive drivers in some instances lead to dangerous situations in which cross traffic does not stop for the oncoming emergency vehicle, with resulting collisions.

A variety of devices have been proposed to allow emergency vehicles to control traffic signals. These typically use radio transmitter systems for activating emergency preemption controls on the traffic signals that will override the normal controls of the signals and provide "stop" signals for cross traffic approaching the intersection and continuous "go" signals for the emergency vehicle. Other special signals have been provided in efforts to provide information to affected drivers regarding the presence and direction of approach of emergency vehicles, whether on intersecting streets or from one direction or the other on the same street. Such systems and devices are well known, and examples are shown in U.S. Pat. Nos. 4,775,865 and 4,704,610 (signs beside traffic signals with vehicle symbols for indicating approaching emergency vehicles); U.S. Pat. No. 6,292,109 (display at corner of intersection with sign shown in FIG. 6 having arrows indicating the direction of an approaching vehicle, a traffic signal with a siren and a flashing red emergency light); and U.S. Pat. No. 6,362,749 (signal device installed in vehicles and having arrows for indicating the direction of the signal from an approaching emergency vehicle, which also could be installed in an undisclosed manner on a traffic signal).

Unfortunately, these prior devices, systems and methods have provided ambiguous and sometimes confusing information and often have been so complex and expensive in construction that they have not been universally installed. Others have been unreliable in operation and have required substantial time and money for maintenance. Accordingly, there has been an ongoing need for an improved and more effective emergency traffic signal device that will overcome the deficiencies of the prior art systems and devices.

BRIEF SUMMARY OF THE INVENTION

The present invention resides in a novel traffic signal device that can be either attached to existing traffic signals or installed in newly constructed signals, and is effective to provide improved visual warning communications to drivers regarding the approach of an emergency vehicle and the actions that are required to avoid the emergency vehicle, and the accompanying method of controlling the traffic signal. For these purposes, a first embodiment of the invention comprises an attachment to the frame or housing of the traffic signal with a special panel that overlies one if the lamps, herein the "green" signal lamp, and is transparent so as to pass the regular light during normal operations, but is electro-optically responsive to an emergency signal to display either a "stop" signal over the regular light, if the emergency vehicle is approaching on a cross street, or a lateral directional movement signal if the vehicle is approaching on the same street. In this manner, traffic not only is warned to stop but also is informed when movement to the side of the roadway is needed. The "stop" signal may be simply a red light superimposed over the regular light of the traffic signal or may be a graphic "halt" or "stop" symbol.

A second, preferred embodiment provides an attachment to the existing frame or housing as a replacement for one of the lamps, and substitutes for the regular lamp a combination LED array that can display the normal color signals (green, yellow or red) during normal operation, and, when activated by an emergency signal, will display a selected emergency signal as in the first embodiment. The graphic directional signal also may be a moving "chevron" or arrow directional signal, or also can be a graphic "hand" symbol indicating direction as well.

In both embodiments, the method of operation comprises the steps of providing the inventive attachment and then controlling the attachment to provide messages in the novel manner described.

Other aspects and advantages of the present invention will be evident from the following drawings, taken in conjunction with the accompanying detailed description.

BRIEF DESCRIPTION OF THE DRAWINGS

FIG. 4 is a perspective view similar to FIG. 1 with a different message on the display panel;

FIG. 5 is a perspective view of an improved display device that is a second embodiment of the invention; and FIGS. 6, 7 and 8 are front elevational views illustrating alternative arrangements and signals that may be provided with the emergency signal device of the present invention.

DETAILED DESCRIPTION

Figure 1:
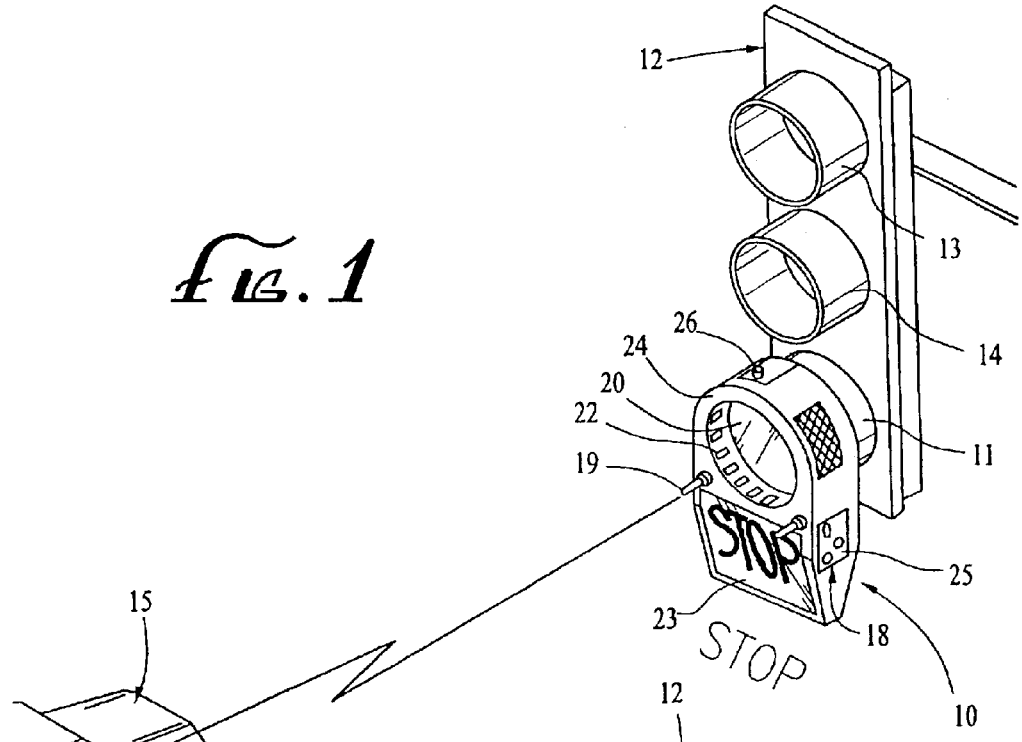
FIG. 1 is a enlarged fragmentary perspective view showing a portion of an approaching emergency vehicle, not to scale, and a representative traffic signal equipped with an emergency traffic signal device in accordance with a first embodiment of the present invention.

As shown in the drawings for purposes of illustration, the invention is embodied in an attachment 10 that is mounted on the green or "go" lamp 11 of a conventional traffic signal 12 also having red and yellow lamps 13 and 14, each comprising a suitable light source (not shown) and an open-ended shroud or shade. A representative emergency vehicle 15 is shown in a position approaching the traffic signal 12 and having a transmitter 17 of a conventional type for actuating the emergency control system. A controller 18 is enclosed in a housing on one side of the signal attachment and receives the transmitted radio signal through an antenna 19. The controller electronically actuates various features of the invention in response to the radio signals received from emergency vehicles that are travelling on the same street or on an intersecting street. The details of construction, electronics and operation of such controllers in these systems are known, as is indicated in the several patents that are identified in the background of this invention.

It has been customary in past systems of this type to enable the emergency vehicles to control the normal, "stop" and "go" signals of the intersection. In addition, some systems sometimes provide signals that indicate the direction of an approaching emergency vehicle and enable drivers of other automobiles, trucks and the like, and even other emergency vehicles, to make decisions as to appropriate evasive actions to avoid interference, or even a collision, with the vehicle that is sending the emergency signal. Typically, as indicated in the cited prior patents, such signals indicate, at most, the direction from which the emergency vehicle is approaching, and leave it to the other drivers to decide what kind of evasive action is appropriate.

In accordance with the present invention, the attachment 10 is an improved emergency signal device that provides clear and unambiguous information to drivers as to the specific action or actions needed to avoid the oncoming emergency vehicle. In addition, the improved device is relatively simple and inexpensive in construction and may be economically retrofitted to existing traffic signals as a self-contained unit or provided as an original component of a new traffic signal that is to be installed.

For these purposes, the attachment 10 herein is fitted onto one of the three standard lamps 11, 13 and 14, herein the lower or "go" lamp 11 of the signal 12, and has a special panel 20 forming a lens or cover for the pre-existing lens 21 of the lamp, a special red light source 22, and a data display panel 23 on one side of the lamp for providing directional information. The attachment 10 is operable when activated to block out the normal green light of the lower lamp 11, to energize the special red light source 22 which is reflected toward oncoming traffic by the special panel 20, and to activate the data display panel 23 to provide a selected directional message determined by the controller 18 in response to the directional signal from the emergency vehicle.

Figure 2:
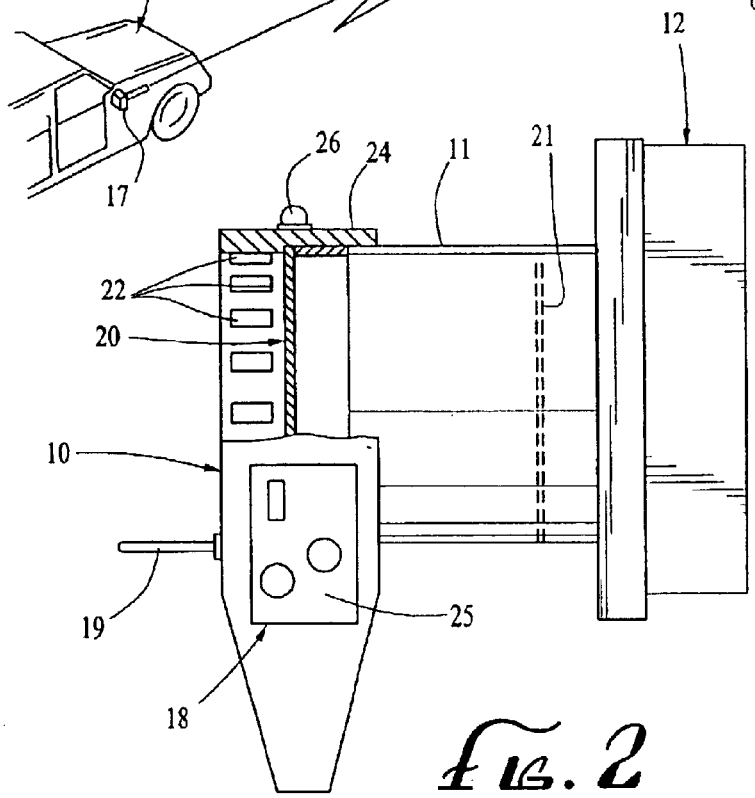
FIG. 2 is an enlarged side elevational view of the emergency signal device of FIG. 1, partially broken away and shown in cross-section.

More specifically, the attachment 10 has a housing that is formed with a tubular upper portion 24 for fitting tightly over the open end of the shade of one of the lamps, herein the lower lamp 11, as shown in FIGS. 1 and 2. The special panel 20 is normally is transparent to the green light and is positioned in front of the regular lens 21, and the special red light source 22 is a series of red lights, such as red-light emitting diodes (LEDs), that are spaced around the open outer side of the tubular portion of the housing, on the side of the special lens panel 20 opposite the regular lens 21.

Figure 3:
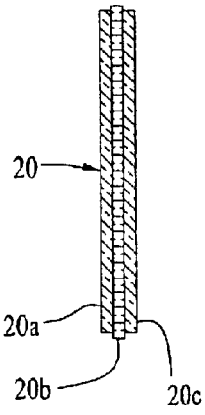
FIG. 3 is a side elevational view of the electro-optically responsive panel of the emergency signal device of FIG. 1.

The special panel 20 of the first embodiment is constructed in multiple laminated layers, herein three indicated at 20*a*, 20*b* and 20*c* in FIG. 3, with the first or outer layer 20*a* having a reflective outside surface but capable of passing light from the regular lamp when the attachment is not activated. Thus, this layer will reflect the red light from the LEDs 30 when the latter are energized. The inside layer 20*b* of the special lens is electro-optically active material that is opaque when activated, thereby to block the normal light from the regular lens 21. The third layer is transparent and, with the outer layer 20*a*, supports the electro-optically active inside layer 20*b*.

With this arrangement, the normal signals from the green light of the traffic signal can be overridden and converted to a red light to signal that traffic approaching the signal is to stop, regardless of the condition of the normal green lamp 11. This is the mode to be used when an emergency vehicle is approaching on an intersecting street and all that is needed of the traffic approaching the signal is to stop at the intersection.

The data display panel 23 is mounted in the housing on one side of the special panel 20, typically either below the panel or to one lateral side, and has the capability of enhancing visual communication with drivers. For this purpose, the display panel also is electro-optically active, preferably in the form of an array of selectively energized LEDs covering virtually the entire panel and capable of providing alternating graphic and/or verbal displays on the panel. For example, as shown in FIG. 1, one display that is appropriate to accompany the red "stop" signal superimposed over the green lamp is the word "STOP" or the abbreviation "STP" that is shown on the display panel. This augments the signal given by the red light. Alternatively, the panel can be made to display the "halt" graphic symbol that is shown on the panel in the alternative embodiment of FIG. 6. This symbol is universally recognizable as meaning "do not pass", as is appropriate when the emergency signal is coming from a vehicle travelling on an intersecting street.

For use in controlling traffic signals on the street on which the emergency vehicle is travelling, the graphic signal on the display panel 23 will give directional information such as an arrow pointing toward the right-hand side of the street, to direct traffic toward the curb, as shown in FIG. 4. This can be coupled with the verbal message "RIGHT", or an abbreviation such as "RGT", as shown on the panel in FIG. 4. Further, for better attention-getting quality, the LEDs in the display panel 18 can be illuminated in a "chevron" pattern, as shown with "RGT" and the arrow symbol in FIG. 4, and the "chevron" pattern can be made to appear to move from left to right, through sequential control of the pattern of illumination of the LEDs. Again, this can be accomplished by the controller 18 in a manner that is well known to those skilled in the art.

Thus, the first embodiment of the invention comprises an attachment with the ability to override the regular "green" signal of a traffic light with a constant "red" until the emergency vehicle passes, and also with the ability to provide a verbal and/or graphic directional signal ordering drivers either to stop or to pull laterally toward the curb. These two signals typically will be combined, but can be given separately as well. Since this attachment is designed to override the normal green "go" signals, it normally is fitted over the lower lamp 11 of vertically aligned lamps as shown in FIG. 1, but also can be placed in other positions as shown in connection with the second embodiment, to be described.

It is to be understood that the antenna 19 is connected by electrical circuitry (not shown) to the controller 18 inside the attachment housing, only the switch panel 25 of the controller being exposed in FIGS. 1, 2 and 4. A compass or other directional instrument 26 is shown on the attachment to assist in orienting the attachment and the controller should directional information be required. The controller has the capability of determining the direction from which a detected signal is coming, thus determining the appropriate actions to be initiated for the signal device.

In addition, the invention is illustrated by a second attachment 35 (FIGS. 5–8), in which a special lamp panel 37 of the general type shown in the first embodiment at 20 provides graphic directional signals as well as color signals to instruct motorists regarding necessary actions. This panel is electro-optically responsive to signals from approaching emergency vehicles to produce either a "stop" signal or a directional signal such as a moving "chevron" pattern directing the motorist toward the curb. In the U.S., this will be the right-hand side as shown in FIG. 5. A graphic "hand" design pointing to the right (not shown) may be provided instead of, or in combination with, such a "chevron" symbol for additional attention-getting impact and communication. To provide these features of operation, the special panel 27 of the alternative attachment 35 is formed as a flat array of LEDs capable of producing contrasting patterns, such as red on a dark background and at least one solid pattern, such as green or yellow, and the controller indicated generally at 38, as in FIGS. 1 and 2, is programmable in a manner well known in the electro-optical arts to produce the desired color or graphic pattern on command. Thus, in the normal operating condition of the traffic signal equipped with the attachment 35 (as a total replacement for the normal lamp), the lamp panel 37 produces the regular signal in the proper sequence, green-colored if the attachment is mounted in the lower, "go" position at 11 as shown in FIG. 6 or yellow-colored if the attachment is mounted in the central "caution" position at 13 as shown in FIG. 7. LEDs of the appropriate color are energized by the controller 25 in the proper regular sequence. In such normal operation, the special display panel indicated generally at 39 can be left blank.

When the controller 38 receives an emergency signal, however, the special lamp panel 37 is energized by the controller 38 to produce the selected graphic and color signals and to terminate the normal color display, as appropriate. For example, when the emergency signal is received from a vehicle travelling in either direction on the same street as the receiving vehicle, the chevron signal shown in FIG. 5 is activated, along with the "RGT" and chevron graphic display shown in FIG. 5. The chevron symbols may be sequentially controlled for even greater impact and clearer meaning. This also is illustrated in different lamp positions in FIGS. 7 and 8.

If the emergency signal is received from an emergency vehicle approaching the intersection on the intersecting street, the controller 38 activates the lamp panel 37 and the data panel 39 in a different manner, because movement of vehicles toward the curb is not the desired response. The controller produces a red, or "stop" signal by activating red light-emitting LEDs in the lamp panel 37, with the accompanying graphic instructional display on a data panel 39.

As an incidental benefit of the presence of the data panel on the traffic light, it is possible to program the controller to receive and display emergency messages of different kinds, such as the well known "Amber Alert" messages. The only limitation in this respect is the size and available space of the data panel, since compactness is a desirable feature.

Accordingly, it will be seen that the invention provides greatly improved directions to motorists in response to the preemptive traffic control signals from approaching emergency vehicles, with an attachment that can be retrofitted to an existing traffic signal in a simple and relatively inexpensive manner to perform the steps of the method of the invention. It also will be evident that the embodiments disclosed are merely illustrative of the invention and that various modifications and changes may be made within the scope of the invention.

We claim as our invention:

1. An emergency traffic signal attachment for use on one lamp of a traffic signal, said attachment comprising:

a housing mountable on the traffic signal over said one lamp thereof and having an opening to pass the light through the housing;

an electro-optically responsive panel in said opening for overlying said one lamp and normally being transparent to pass light through the opening, said panel having a reflective outer surface and being operable when energized to become opaque;

a source of red light on said housing on the side of the panel opposite said one lamp and operable when energized to produce red light to be reflected by the panel as a substitute for the light of normal operation;

and a controller responsive to preemptive signals from approaching emergency vehicles on an intersecting street and operable to energize said panel to become opaque and to energize said red light source, thereby to override the normal operation of the traffic signal.

2. An emergency traffic signal attachment as defined in claim 1 wherein said housing has a tubular portion for fitting over a shade on the green lamp and forming said opening, said panel being fitted in said tubular portion to lie in front of the said one lamp.

3. An emergency traffic signal attachment as defined in claim 2 wherein said source of red light is a series of light-emitting elements mounted in said tubular portion around said panel.

4. An emergency traffic signal attachment as defined in claim 2 wherein said housing includes an extension on one side of said tubular portion, and further including an electro-optically responsive data display panel on said extension.

5. An emergency traffic signal attachment as defined in claim 1 wherein said one lamp is a green lamp.

6. An emergency traffic signal attachment as defined in claim 4 wherein said controller is responsive to the direction of detected signals and is operable to produce both "stop" messages and messages directing motorists to move laterally.

7. An emergency traffic signal attachment as defined in claim 6 wherein the available displays include a form of the word "stop" and a form of the word "right".

8. An emergency traffic signal attachment as defined in claim 7 wherein the form of the word right is combined with a direction-indicating graphic.

9. An emergency traffic signal attachment as defined in claim 8 wherein the direction-indicating graphic is a chevron pattern that is sequentially displayed to appear to be moving toward the right.

10. An emergency traffic signal attachment as defined in claim 5 wherein the "stop" message includes a graphic "hand" symbol.

11. A traffic signal attachment for use on one lamp of a traffic signal mounted at the intersection of roadways, said attachment comprising:

a housing mountable on the traffic signal in the position of said one lamp and having an opening for passing green light from the housing;

an electro-optically responsive panel in said housing having light-emitting elements capable of being energized in different patterns and emitting different light signals, said elements including a first set of elements for emitting a colored light and a second set of elements for producing selected emergency instruction signals;

and a controller for energizing said first set of light-emitting elements according to a normal schedule and, in response to preemptive signals from an emergency vehicle on one of the roadways, activating selected light-emitting elements of said first and second sets to produce the selected pattern.

12. A traffic signal attachment as defined in claim 11 wherein said light-emitting elements are arranged and controlled to produce a chevron pattern in said opening indicating movement toward one side when said second light-emitting elements are energized.

13. A traffic signal attachment as defined in claim 12 in which said controller sequentially controls the second light-emitting elements to produce a pattern that appears to move toward said one side.

14. A traffic signal attachment as defined in claim 11 further including an electro-optically responsive data display panel on said housing beside said opening, and wherein said controller is operable in response to said preemptive signals to energize said panel to provide visual directional instructions.

15. A traffic signal attachment as defined in claim 14 wherein said visual instructions include a graphic symbol instructing movement to the side of the roadway, to be produced in response to a signal from an emergency vehicle on the same roadway.

16. A traffic signal attachment as defined in claim 15 wherein the symbol includes an arrow.

17. A traffic signal attachment as defined in claim 15 wherein the symbol includes a chevron pattern.

18. A traffic signal attachment as defined in claim 14 wherein said visual instructions include instructions to stop, to be produced in response from a signal from an emergency vehicle on an intersecting roadway.

19. A traffic signal attachment as defined in claim 18 wherein the instructions include a form of the word "stop".

20. A traffic signal attachment as defined in claim 18 wherein the instructions include a hand symbol providing a "halt" instruction.

21. A traffic signal attachment as defined in claim 14 wherein the directional instructions include both a verbal instruction and a corresponding graphic symbol.

22. A traffic signal mounted at the intersection of roadways and having a plurality of lamps, having in combination:

a housing mounted on the traffic signal in the position of one of the lamps and having an opening for passing light from the housing;

an electro-optically responsive panel in said housing having light-emitting elements capable of being energized in different patterns and emitting different light signals, said elements including a first set of light-emitting elements for emitting a colored light and a second set of elements for producing selected emergency signals;

and a controller for energizing said first set of light-emitting elements according to a normal schedule, and, in response to preemptive signals from an emergency vehicle, actuating selected light-emitting elements of said first and second sets to produce the selected pattern.

23. A traffic signal as defined in claim 22 further including further including an electro-optically responsive data display panel on said housing beside said opening, and wherein said controller is operable in response to said preemptive signals to energize said panel to provide visual directional instructions.

24. A traffic signal as defined in claim 23 wherein the directional instructions include both a verbal instruction and a corresponding graphic symbol.

25. The method of controlling a traffic signal having a plurality of traffic lamps in response to preemptive emergency signals from emergency vehicles for overriding the normal operation of the traffic signal, the traffic signal being disposed at an intersection of roadways, said method comprising the steps of:

providing an attachment for the traffic signal having a data display panel and an electro-optically responsive panel associated with a selected one of the traffic signals to display a red light upon command regardless of the normal operation of the lamp;

providing a controller for detecting the preemptive emergency signal, determining the direction from which signals are approaching the controller, and activating said electro-optically responsive panel to provide the red light when the signal is approaching from an intersecting roadway, and for activating said data display panel to provide an instructional message for motorists, selected from a plurality of available messages;

and providing in said plurality of available messages for display on said data display panel a first graphic message commanding the motorist to stop, for display with the red light when the signal is approaching on an intersecting roadway, and a second graphic message commanding the motorist to move laterally on the roadway to an out-of-the-way position when the signal is approaching on the same roadway.

26. The method as defined in claim 25 wherein said first graphic message is provided with a form of the word "stop".

27. The method as defined in claim 25 wherein said first graphic message is provided with a representation of a hand as a "halt" symbol.

28. The method as defined in claim 25 wherein said second graphic message includes a chevron pattern indicating movement to one side of the roadway.

29. The method as defined in claim 27 wherein said chevron graphic is sequentially varied to appear as a moving pattern moving toward said one side.

30. The method as defined in claim 25 wherein said second graphic message includes an arrow pointing to one side of the roadway.

31. The method as defined in claim 25 wherein said second graphic message includes a verbal display instructing movement in one lateral direction.

32. The method as defined in claim 31 wherein the verbal display is a form of the word "right."

33. The method as defined in claim 25 wherein said second message in includes a verbal display instructing movement in one lateral direction and a graphic symbol pointing in that direction.

34. The method of controlling a traffic signal at an intersection of roadways having a plurality of traffic lamps in response to preemptive emergency signals from emergency vehicles on the roadways for overriding the normal operation of the traffic signals, said method comprising the steps of:

providing an attachment for the traffic signal having a first electro-optically responsive panel associated with one of the traffic lamps and capable, when activated, to provide a red light regardless of the normal operation of the lamp and also having a second electro-optically responsive panel forming a data display panel beside said first panel;

providing a controller for detecting the preemptive emergency signals, and determining the direction from which the emergency signal is approaching;

and activating said optically-responsive panel to provide a red light when a signal is received from a vehicle approaching on an intersecting street and displaying a visual message on the data display panel indicating the appropriate action to be taken by motorists approaching the traffic signal to avoid interference with the emergency vehicle.

* * * * *